US011619054B2

(12) United States Patent
Skatzka

(10) Patent No.: US 11,619,054 B2
(45) Date of Patent: Apr. 4, 2023

(54) CONSTRUCTION JIG

(71) Applicant: Dennis Skatzka, Lenox, MI (US)

(72) Inventor: Dennis Skatzka, Lenox, MI (US)

( * ) Notice: Subject to any disclaimer, the term of this patent is extended or adjusted under 35 U.S.C. 154(b) by 623 days.

(21) Appl. No.: 16/665,742

(22) Filed: Oct. 28, 2019

(65) Prior Publication Data

US 2020/0131788 A1 Apr. 30, 2020

Related U.S. Application Data

(60) Provisional application No. 62/751,343, filed on Oct. 26, 2018.

(51) Int. Cl.
*E04G 21/18* (2006.01)
*E04B 1/00* (2006.01)

(52) U.S. Cl.
CPC ..... *E04G 21/1891* (2013.01); *E04B 1/003* (2013.01)

(58) Field of Classification Search
CPC ... E04G 21/1891; E04H 17/26; E04H 17/261; Y10S 269/904
See application file for complete search history.

(56) References Cited

U.S. PATENT DOCUMENTS 4,836,517 A * 6/1989 Vossler ..... E04G 21/26 269/904
4,989,336 A * 2/1991 Waltrip, Jr. ..... E04F 21/003 33/526
5,163,233 A * 11/1992 Benson ..... E04G 21/1841 269/904
5,192,059 A * 3/1993 Silver ..... E04D 13/158 269/45
5,673,903 A * 10/1997 Lewis ..... E04H 17/26 269/904
D425,771 S * 5/2000 Dearing ..... D8/71
2011/0219724 A1* 9/2011 Davis ..... E04G 21/1891 33/354
2013/0174498 A1* 7/2013 Hovren ..... E04G 21/1891 52/749.1
2013/0247405 A1* 9/2013 Jones ..... E04G 21/1891 33/534
2016/0018206 A1* 1/2016 Hollis ..... G01C 9/34 33/354
2017/0044752 A1* 2/2017 Higginbotham ..... E04B 1/003

FOREIGN PATENT DOCUMENTS

KR 200476265 Y1 * 2/2015

* cited by examiner

*Primary Examiner* — Christine T Cajilig
(74) *Attorney, Agent, or Firm* — Cargill & Associates, PLLC; Lynn E. Cargill

(57) ABSTRACT

A construction jig is disclosed for facilitating appropriate notched cuts in vertical posts used for deck or post and beam construction applications. The jig is a multi-sided jig adapted to be either slipped over or slipped around a vertical post commonly used in such constructions. A crossmember for the construction is held by the jig and the jig is moved up and down until the crossmember is level. A saw is then guided by the jig to make an appropriately level notch in the vertical post, as required by building codes. An optional handle is useful, and it may extend outwardly from a side of the construction jig, which is adapted for movable and removable placing of the multi-sided jig over the vertical post to indicate level placement for the deck crossmember.

2 Claims, 14 Drawing Sheets

CONSTRUCTION JIG

CROSS-REFERENCE TO RELATED APPLICATIONS

This application claims the benefit under 35 U.S.C. 119(e) of U.S. Provisional Application No. 62/751,343 filed Oct. 26, 2018.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS WEB)

Not Applicable

STATEMENT REGARDING PRIOR DISCLOSURES BY THE INVENTOR OR A JOINT INVENTOR

Not Applicable

BACKGROUND OF THE INVENTION

1. Field of the Invention

The present invention relates to a construction jig, methods of manufacturing same, and methods of using same. More particularly, the invention relates to a jig to easily construct decks, post and beam timbers, and even fence posts.

2. Description of the Prior Art

Conventional deck construction has previously attached support crossbeams to the side of vertical posts that have been embedded into the ground. The means for attachment has been traditionally utilized through bolts extending through the crossbeams and the vertical posts. This conventional prior art attachment of a crossbeam to a vertical post no longer complies with building codes. As one can imagine, a crossbeam attached to a vertical post by through bolts can come apart after years of wear and tear. Lengthy periods of fatigue and corrosion can cause the through bolts to fail, resulting in harm or injury to persons that may crash through the deck. To remedy this failure, building codes have now been revised to require a notched vertical post construction to receive the crossbeam, thereby providing superior support.

Problems have arisen since the through bolts have rusted and given way under heavy weight, causing injury to anyone standing on the deck. Consequently, building codes have changed such that the crossbeams have to be notched into the vertical posts to provide greater support. In the construction of decks, it has been a difficult problem to perfectly notch out the posts to receive the crossbeams. Up until now, the notching operation has involved a mandatory use of at least two construction workers, utilization of several handheld levels, followed by cutting of imperfect notches into the vertical posts.

The construction industry needed a better way. It took two workers to determine the proper location and position of an appropriate notch in the vertical post. One would hold the crossbeam in a level position, while the other worker would mark and cut the notch out of the vertical post. Needless to say, turning this cutting operation into a one man job is much preferable, both for a professional contractor as well as a single man homeowner attempting to make his own deck.

Although jigs have been known in the woodworking and construction arts, including one of the most common types of jigs that includes wood working jigs, such as a table saw jig for aiding in precision cuts, no one had made a sufficiently complex jig to allow for the perfect cutting of notches into a vertical post, while allowing a perfectly level construction of the crossbeam.

Similar problems occur during the construction of post-and-beam timber frame homes, fencing posts, and any type of construction where a crossbeam can be notched into a vertical support post.

Practitioners of those shop-type jig inventions have not extended that concept to leveling timbers during the construction of decks, post-and-beam timber construction or fencing installations, even though there has been a long felt need to make such installations simpler.

It would be desirable to the construction industry if there was provided a jig to aid in the proper installation of timbers for decking, post-and-beam timber construction and fencing, among other applications, a method of making such a jig, or a method of using one.

SUMMARY OF THE INVENTION

In accordance with the above-noted desires of the industry, the present invention provides various aspects, including a handheld construction jig that is easy to use, easy to remove, aids in the perfect leveling of timbers every time, a method of making the same, and a method of using it to precisely install timbers for these various construction projects, as well as other installations requiring level timbers.

Although the invention will be described by way of examples hereinbelow for specific aspects having certain features, it must also be realized that minor modifications that do not require undo experimentation on the part of the practitioner are covered within the scope and breadth of this invention. Additional advantages and other novel features of the present invention will be set forth in the description that follows and in particular will be apparent to those skilled in the art upon examination or may be learned within the practice of the invention. Therefore, the invention is capable of many other different aspects and its details are capable of modifications of various aspects which will be obvious to those of ordinary skill in the art all without departing from the spirit of the present invention. Accordingly, the rest of the description will be regarded as illustrative rather than restrictive.

BRIEF DESCRIPTION OF THE DRAWINGS

For a further understanding of the nature and advantages of the expected scope and various aspects of the present invention, reference shall be made to the following detailed description, and when taken in conjunction with the accompanying drawings, in which like parts are given the same reference numerals, and wherein.

DETAILED DESCRIPTION OF THE INVENTION

Figure 1A:
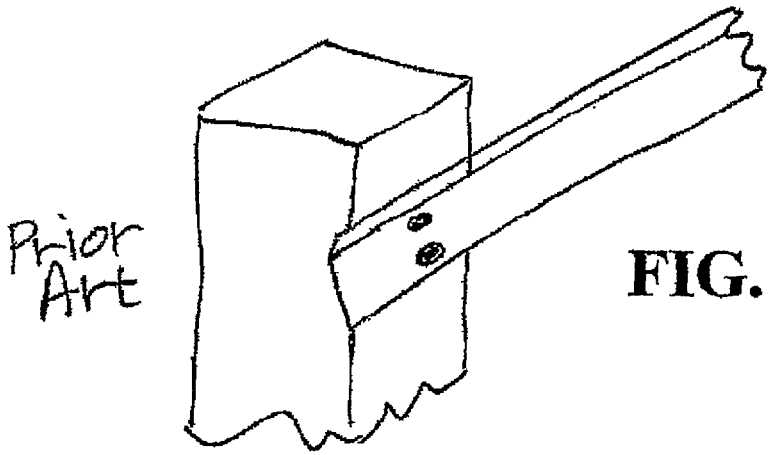
FIG. 1A is a front perspective view of a prior art conventional attachment of a crossbeam to a vertical post, which no longer complies with building codes.
Figure 1B:
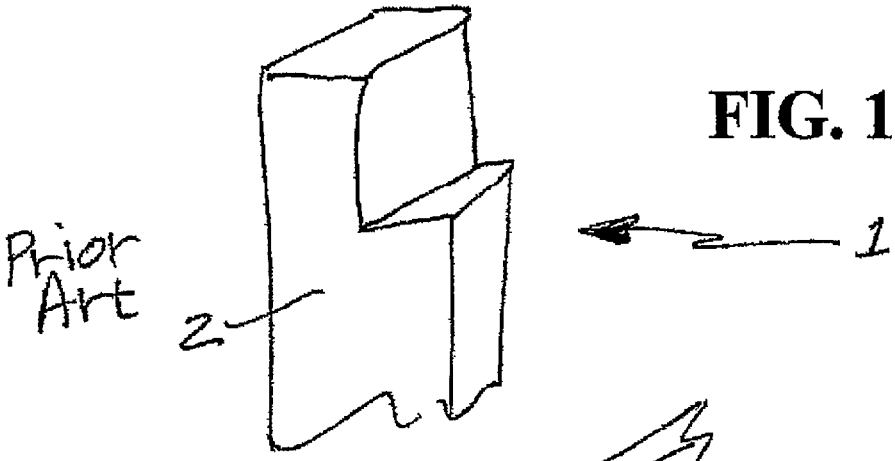
FIG. 1B illustrates and details a prior art approach notched vertical post that complies with new building codes.
Figure 1C:
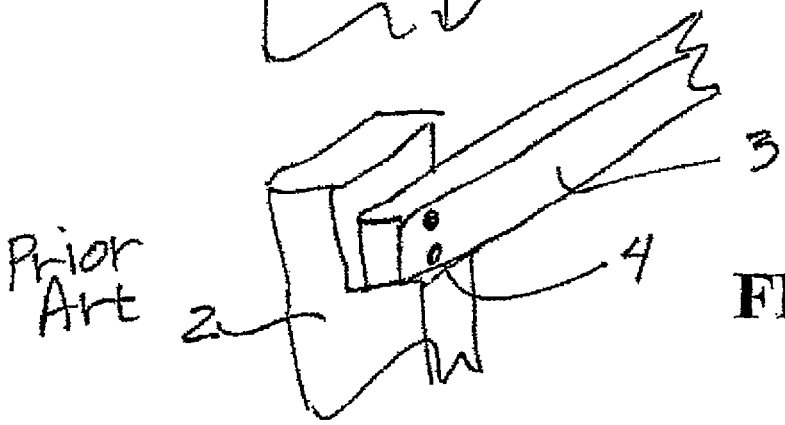
FIG. 1C shows how the prior art notched vertical post crossbeam of FIG. 1B is now supported on the notched top of the vertical beam, currently in compliance with the building codes.

Referring now to the drawings in detail, and with combined reference to FIGS. 1A-1C, FIG. 1A is a front perspective view of a conventional prior art attachment of a crossbeam to a vertical post, which no longer complies with building codes. As one can imagine, a crossbeam attached to a vertical post by through bolts can come apart after years of wear and tear. Lengthy periods of fatigue and corrosion can cause the through bolts to fail, resulting in harm or injury to persons that may crash through the deck. Building codes have now been revised to require a notched vertical post construction to receive the crossbeam, thereby providing superior support.

In that regard, the present invention provides a construction jig that allows for easy, reliable notching of the vertical post, while allowing easy leveling of the crossbeam's to make deck construction much easier. It is important to have the notches in the vertical post be level, uniform and easy to saw out. Notched vertical post is generally denoted by numeral 1, and shows the notch cut into vertical post to which supports a crossbeam there to comply with current building codes.

It would be advantageous to construction workers in the deck construction, post-and-beam timber frame construction, and fencing installation industries, among others, to have an easy to use construction jig which takes into consideration all the advantageous means for cutting uniform notches into vertical posts, and aiding in leveling of crossbeams prior to permanent securement.

Looking now to FIGS. 2A-2D, and with combined reference to the element numbers, a construction jig for deck construction applications is generally denoted by numeral 10, and includes a handle 12 attached to jig 10 for placement over a vertical post 14, and supporting crossbeam 16 by crossbeam support 30 in a proper place for leveling. In using the construction jig for deck construction, the jig is set over the vertical post 14 and, by use of handle 12, the jig is placed up or down on the vertical beam in response to a horizontal level placed on the crossbeam 16 (not shown). Once the level shows the proper orientation of crossbeam 16, set screw 24 is used to secure jig 10 to vertical post 14. A saw would then be urged against vertical saw guides 18 and 22 to notch out the vertical post in order to receive crossbeam 16 in compliance with building codes. Looking to FIG. 2B, one can see a rear elevational view of the jig 10, and in this view there are shown pencil slots 28 in jig back rest 26 so that when the jig is in the proper location and set by set screw 24, a pencil can be slid through pencil slots 28 to indicate where the vertical post should be cut.

Specifically, disclosed is a construction jig for making notched cuts for deck and deck crossmember construction applications, comprising a substantially four-sided jig adapted to be slipped over a vertical post commonly used in deck construction. A handle extends outwardly from a side of the construction jig, wherein the handle is attached to the construction jig, adapted for movable and removable placing of the four-sided jig over the vertical post to indicate level placement for the deck crossmember.

An L-shaped crossbeam support portion of the jig extends laterally outward from a side of the construction jig, such that the L-shaped crossbeam support is adapted to receive and hold a crossbeam in place while facilitating its attachment to the vertical post in a level position. Preferably, a level may be set on top of the crossmember. By moving the jig up and down with the handle until the level shows that the crossmember is level, the perfect position for the cut to make the notched cut is indicated.

An optional set screw may be integral with the construction jig, so that the jig can be secured into proper position for the cutting operation.

Once the crossmember has been removed, and the jig is set in place, then the worker can cut the necessary notch(s) by traversing saw guides in the jig. Integral saw guides extending horizontally and vertically that correspond to proper level placement for making a level notched cut into the vertical post for receiving the deck crossmember.

This way, the four-sided jig may be slid over and onto the vertical post, while a crossbeam is then placed in the L-shaped crossbeam support and the jig is moved up and down until the crossbeam is level, indicating where the notched cut must be made. By using the jig, this operation of cutting out the necessary notch can be implemented reliably every time with only one worker.

Figure 2A:
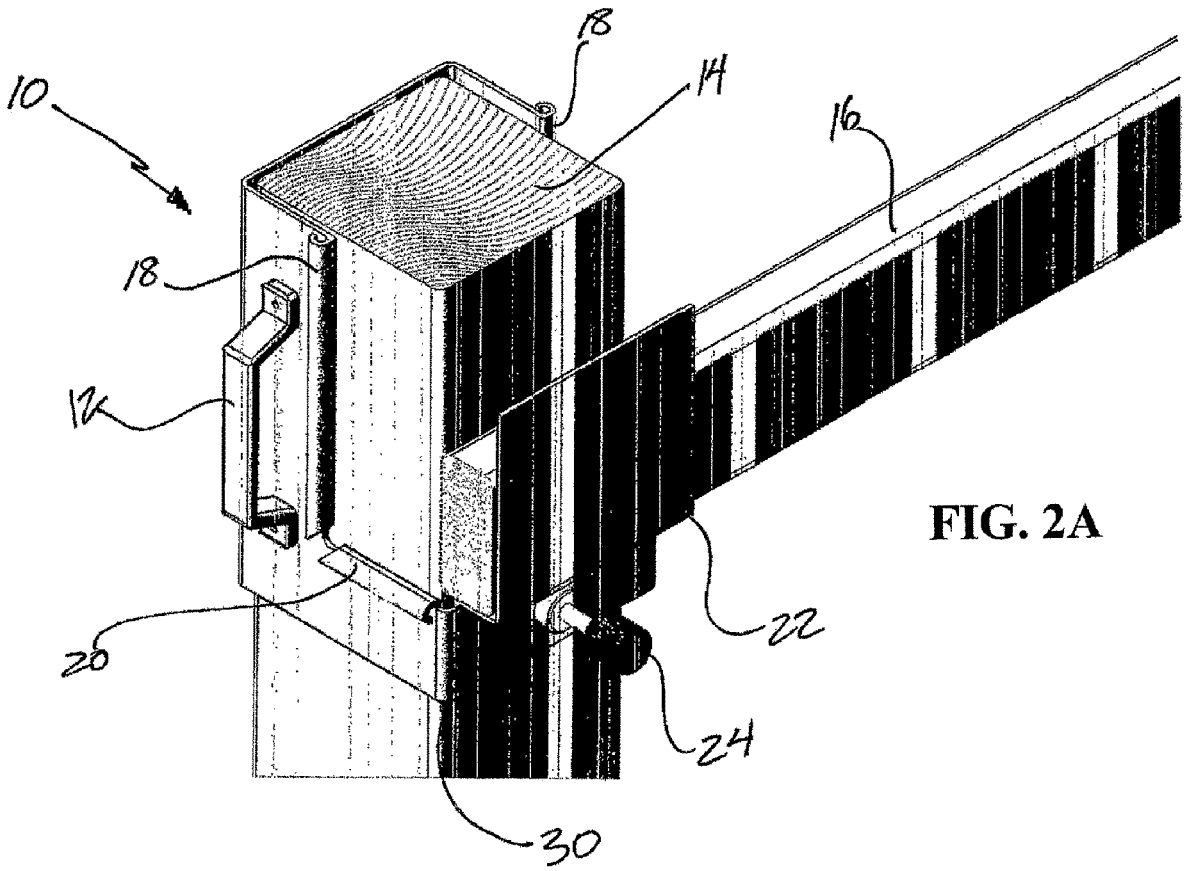
FIG. 2A is a front perspective view of a new construction jig made in accordance with the present invention for 6×6 posts.
Figure 2B:
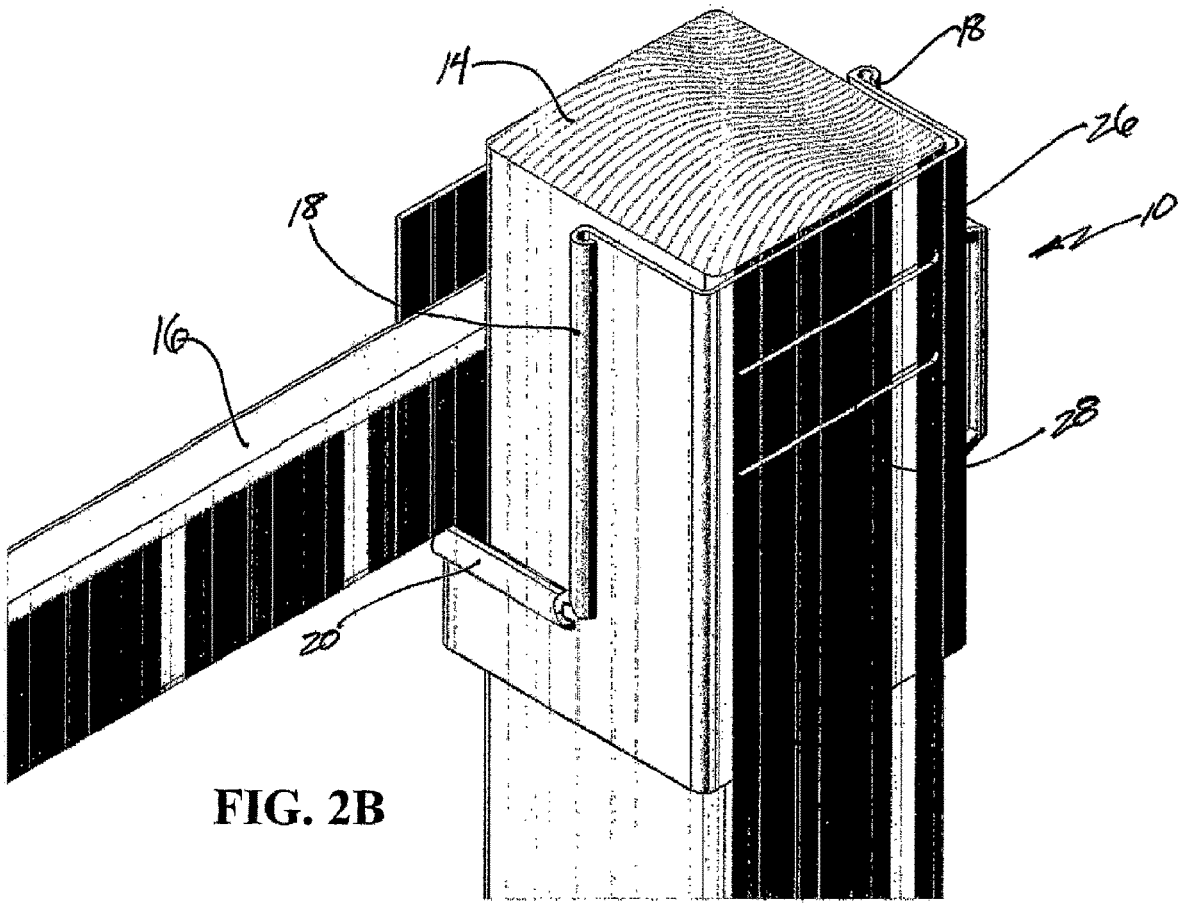
FIG. 2B is a rear perspective view of the construction jig of FIG. 2A made in accordance with the present invention.
Figure 2C:
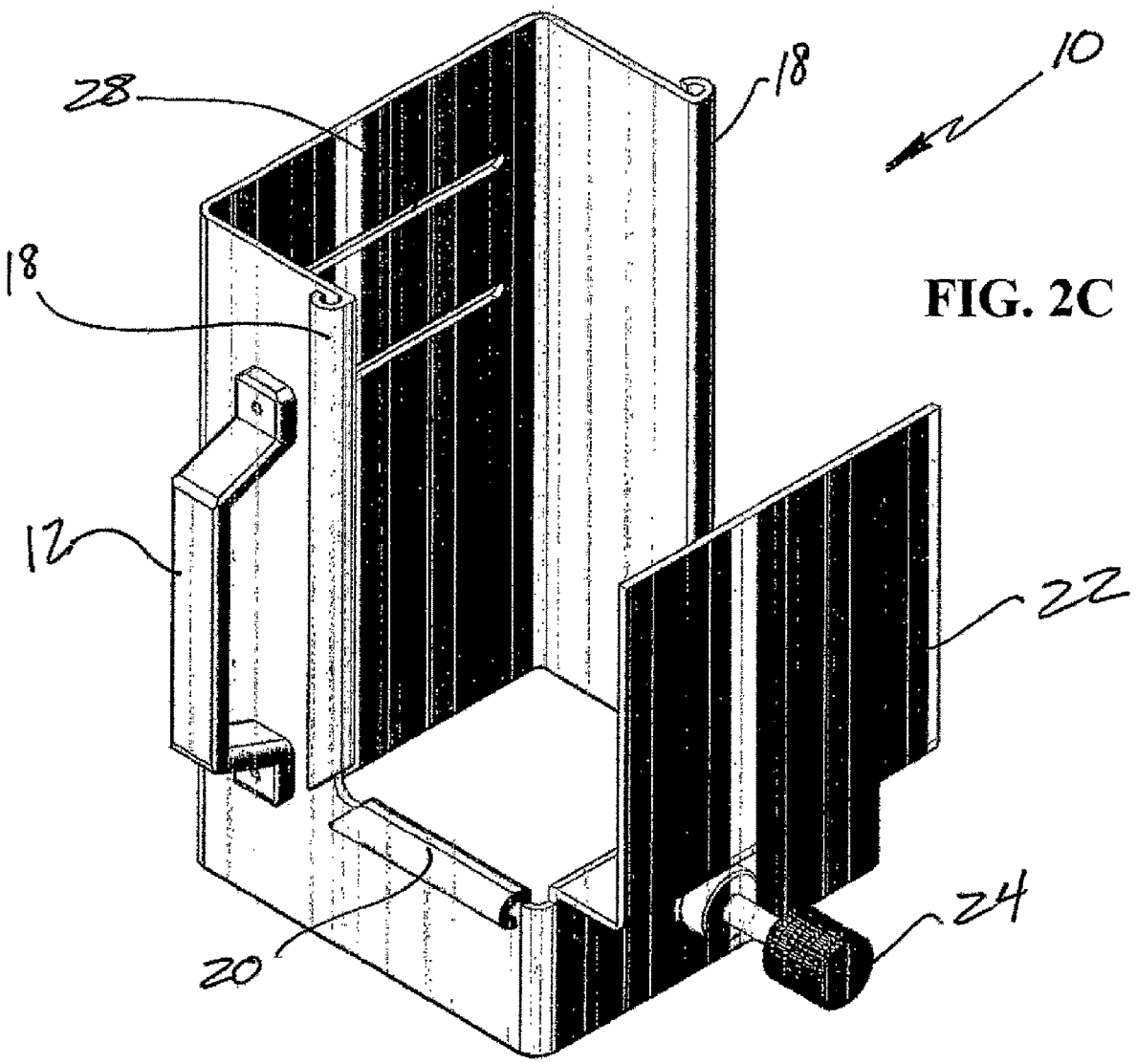
FIG. 2C is a perspective view of the present invention shown without the vertical post and crossbeam installed.
Figure 2D:
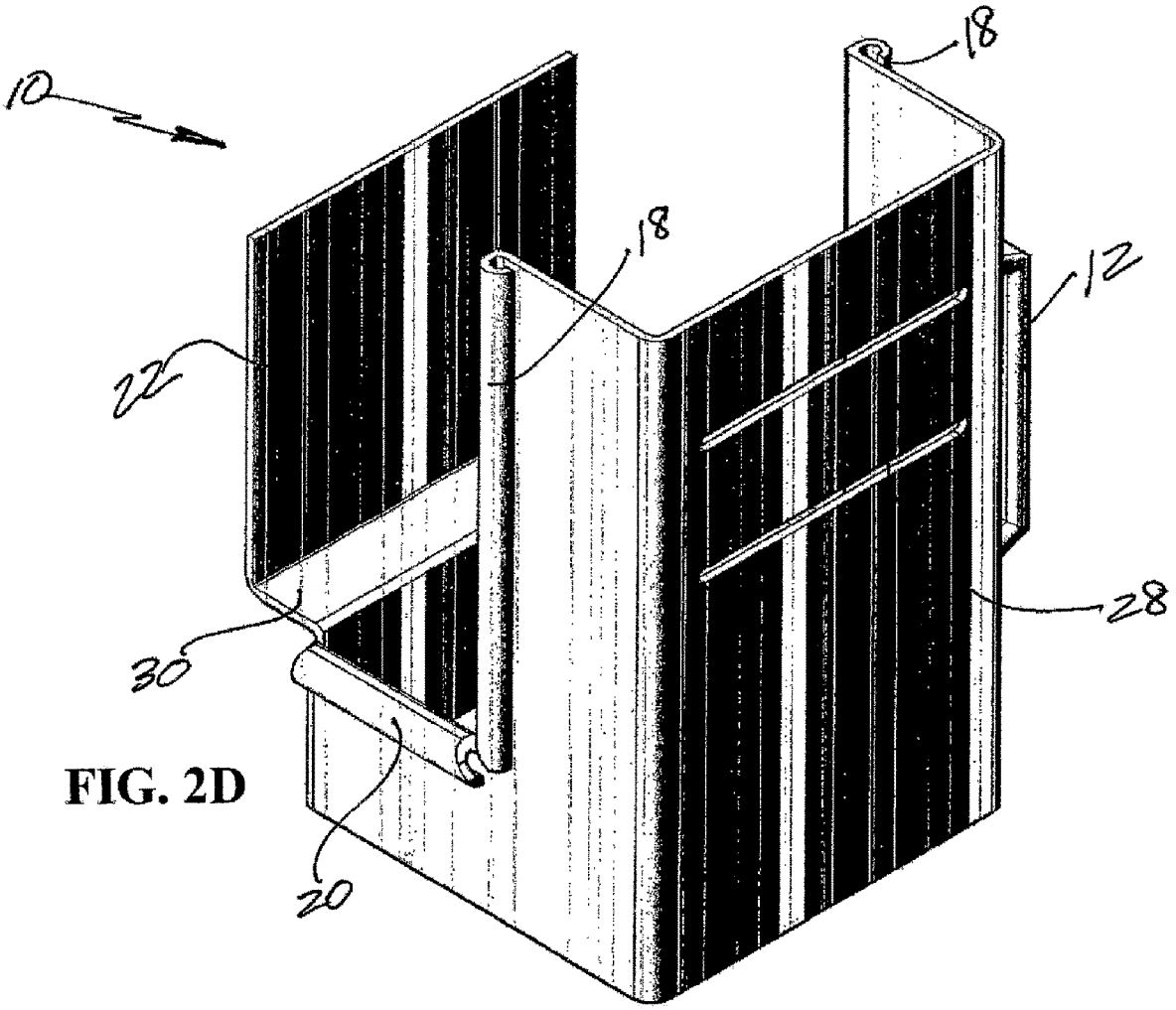
FIG. 2D is a rear perspective view of the present invention showing the pencil slots to be used for marking where to cut.

FIG. 2C shows another view of construction jig 10, but the vertical post and crossbeams, 14 and 16, respectively, have been removed to illustrate how vertical saw guides 18 and horizontal saw guides 20 makes cutting the vertical notches into the vertical post much easier. In practice, one can either run a pencil along saw guides 18 and 20, or a Sawzall® type of saw can be used without damaging the jig, as the Sawzall® blade is sufficiently long to traverse across the two vertical saw blade guides and the horizontal saw blade guide 20. FIG. 2D shows a rear view of the construction jig 10 adapted for deck construction, and further illustrates pencil slots 28 so that once the jig is secured into place by set screw 24, a pencil can be slid through slots 28 to mark the appropriate place to cut.

Figure 3A:
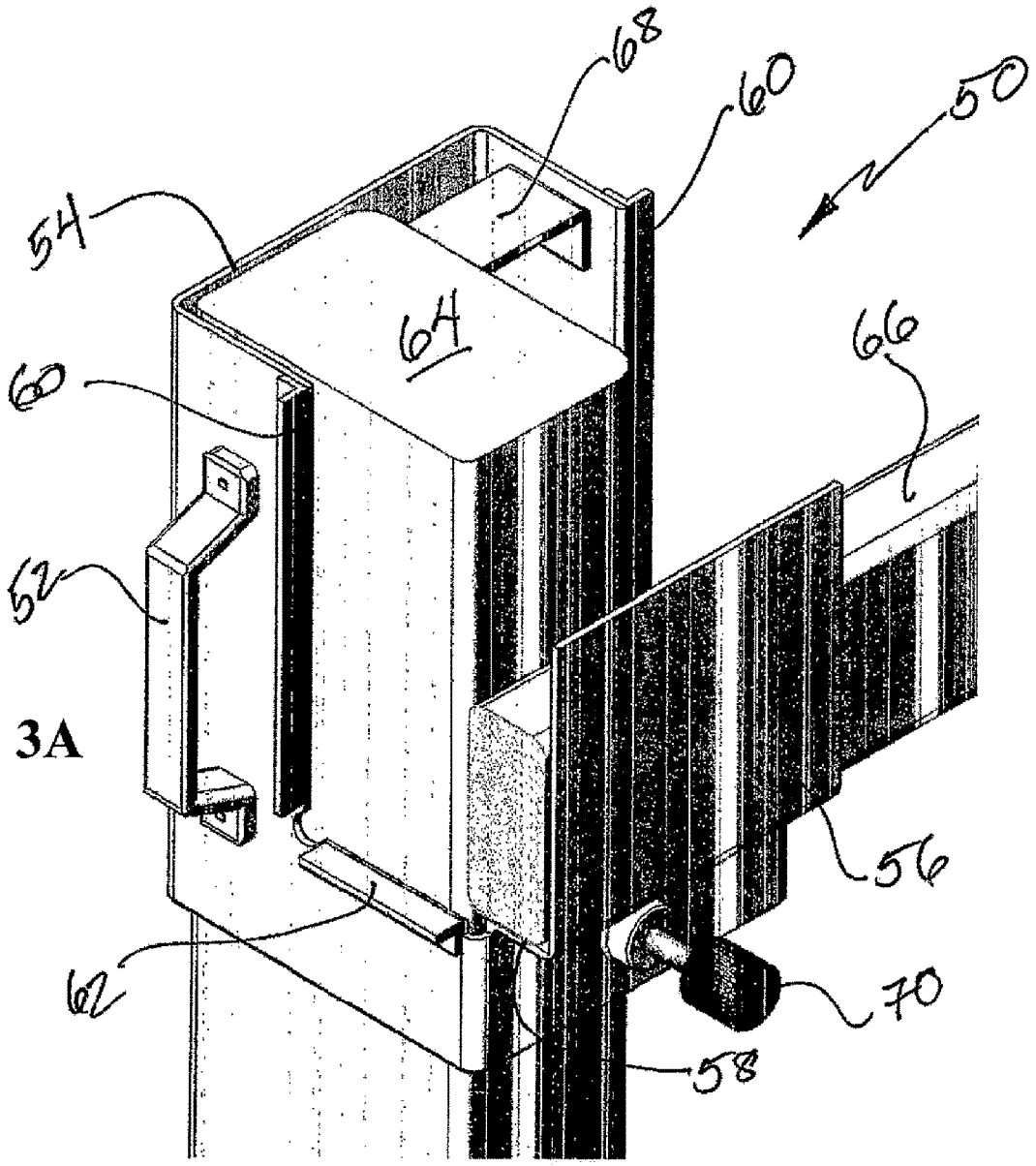
FIG. 3A is a front perspective view of yet another aspect of the present invention, being adapted to receive 4×6 posts.
Figure 3B:
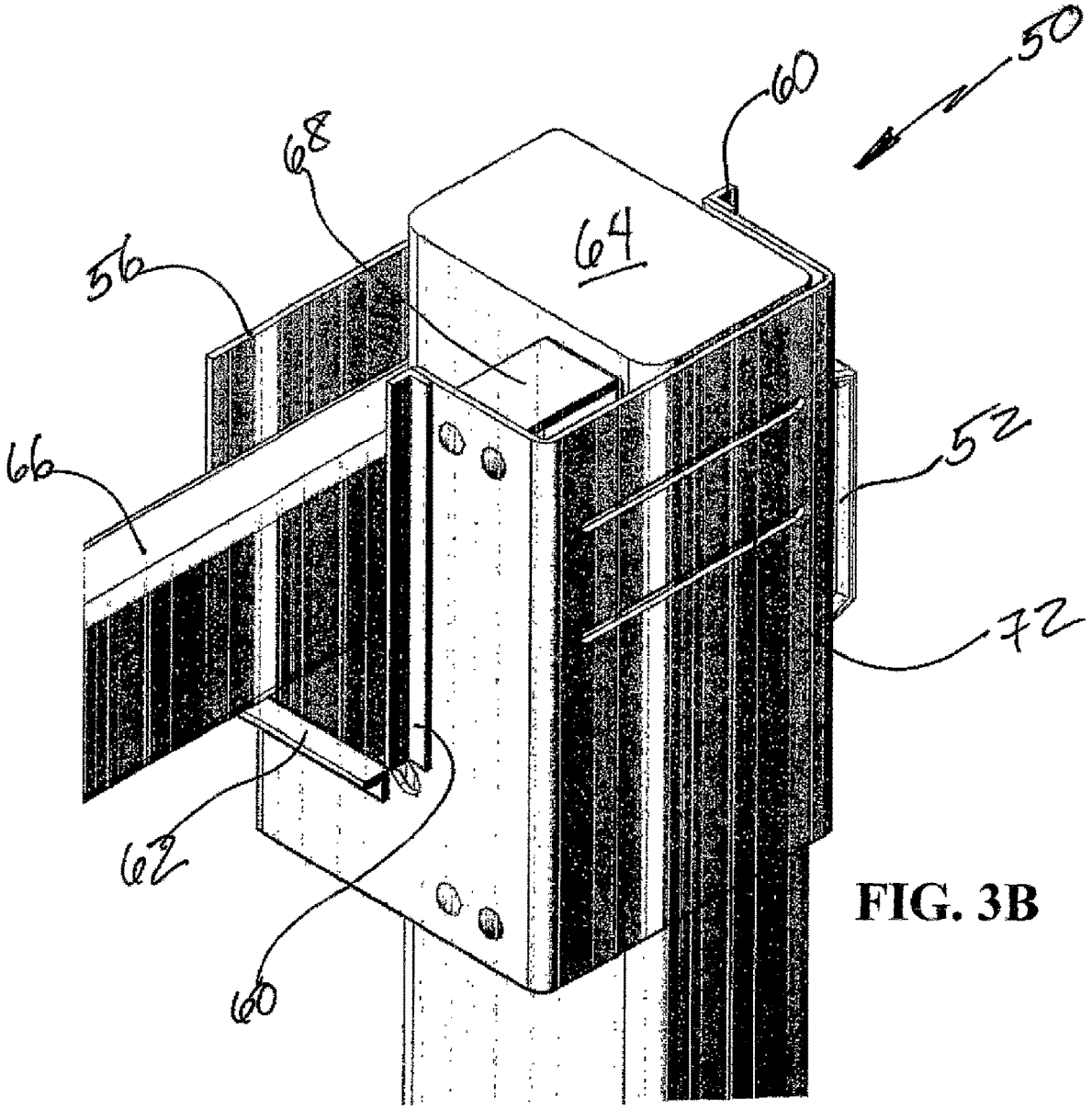
FIG. 3B is a rear perspective view of the 4×6 post-adaptation of the present invention.
Figure 3C:
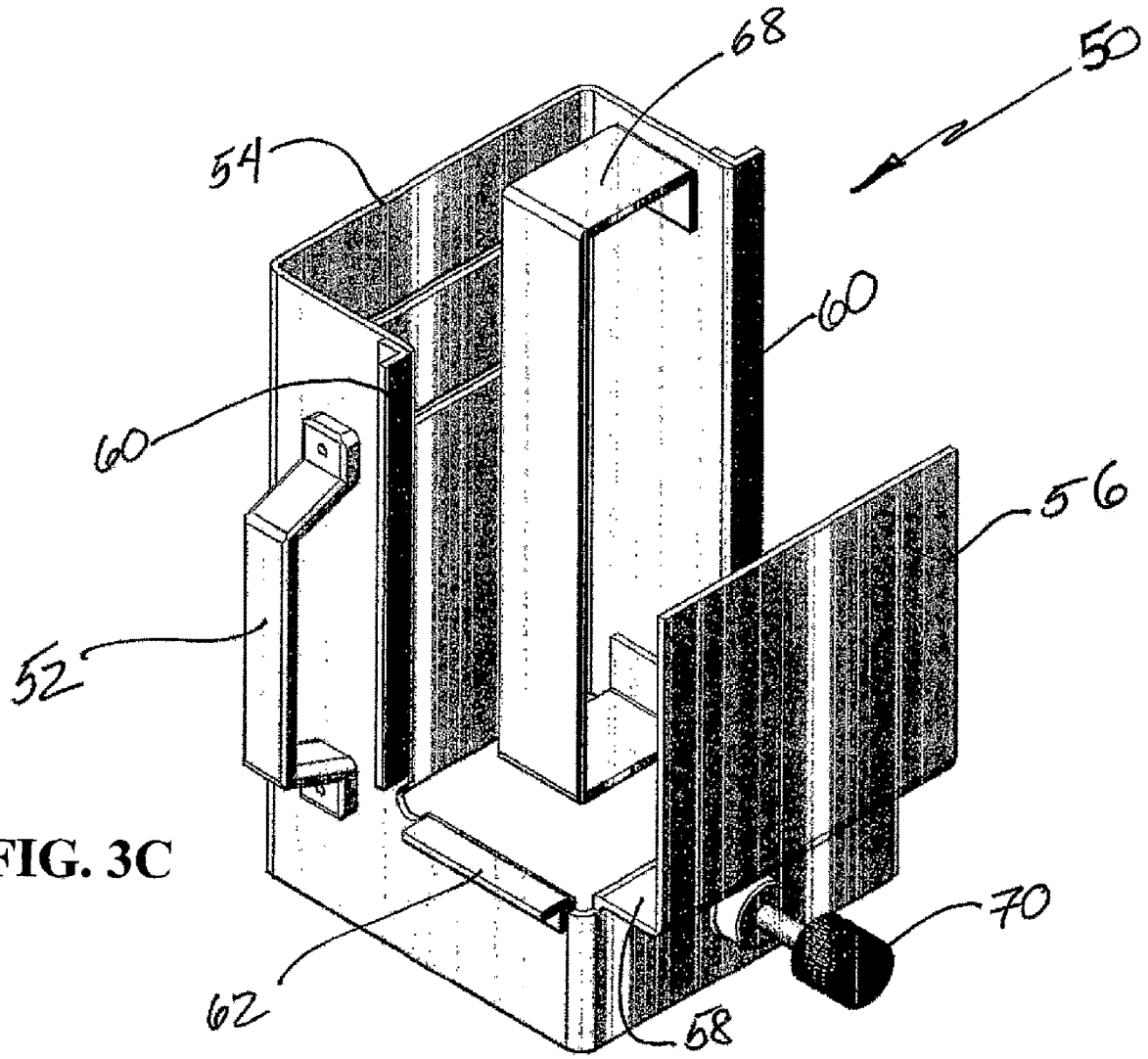
FIG. 3C is a front perspective view of the present invention without the 4×6 post shown therein.

Looking now to FIGS. 3A-3C, and with combined reference to the element numbers, another aspect of the present invention is disclosed for use with 4×6 posts, rather than the 6×6 posts illustrated above. An adapted construction jig for deck construction applications is generally denoted by numeral 50, and also includes a handle 52 for, once again, urging the jig 50 up and down in response to a leveling device on top of crossbeam 66 (not shown), with relative placement against vertical post 64. Again, a pair of vertical saw guides 60 and a horizontal saw guide 62 will be used to either urge pencil markings for later cutting with a circular saw, or may be used to support the blade of a Sawzall® to make a perfect, uniform cut to form a notched area to receive crossbeam 66. A width adapter 68 is attached within jig 50 in order to support vertical post 64. Vertical post 64 is further supported by jig back rest 54, while crossbeam 66 is supported on a crossbeam support shelf 58 and a crossbeam support 56. As before, once the level on crossbeam 66 indicates the proper placement, this construction jig 50 is secured in place by set screw 70.

FIG. 3B illustrates a rear elevational perspective view to show pencil slots 72, which are to be used to mark where a cut should take place. FIG. 3C illustrates this aspect of the present invention without the vertical post or the crossbeam being shown, in order to provide better detail with the vertical post location adapter 68.

Figure 4A:
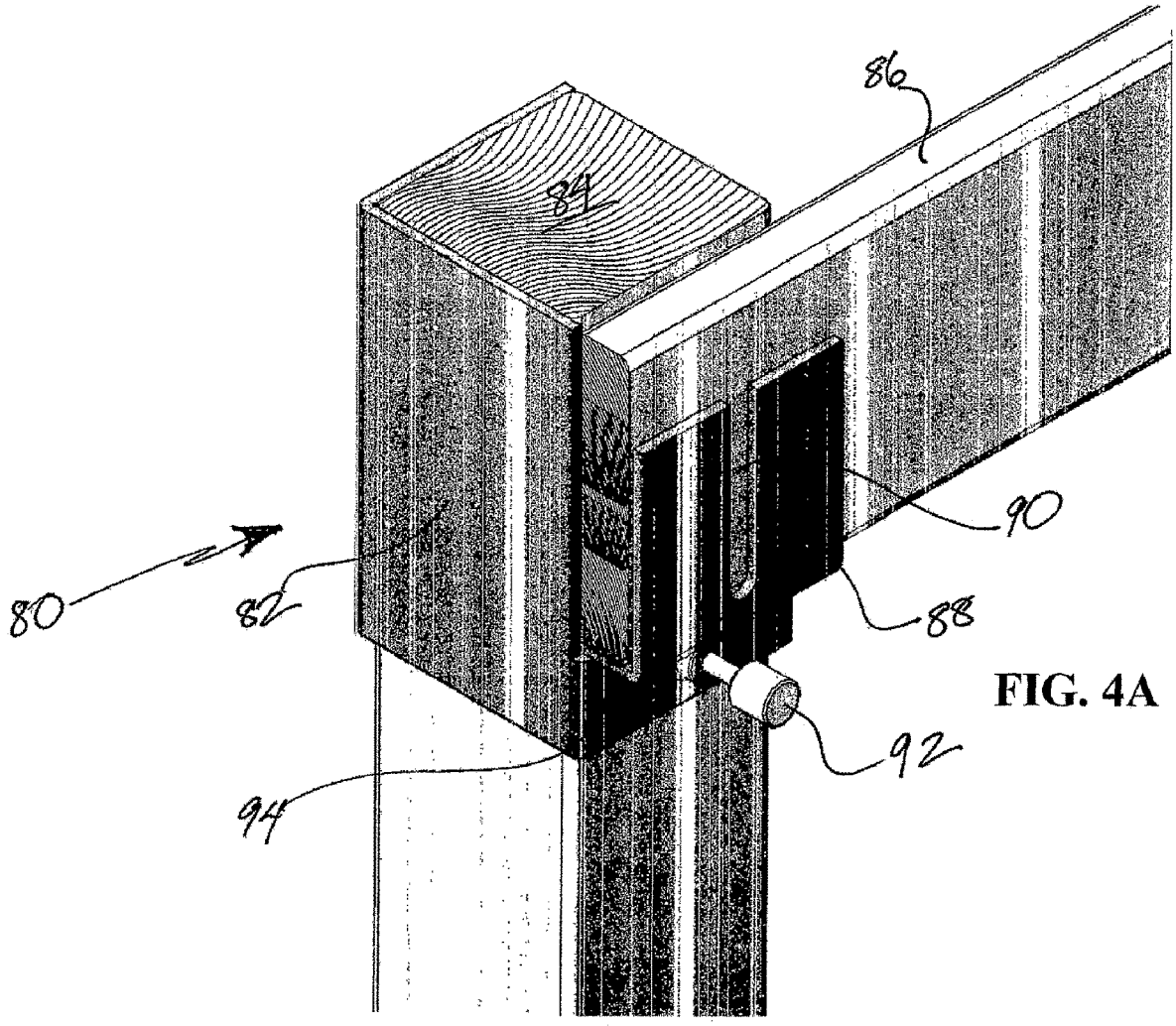
FIG. 4A is a front perspective view of yet another aspect of the present invention, to be used with construction of post-and-beam.
Figure 4B:
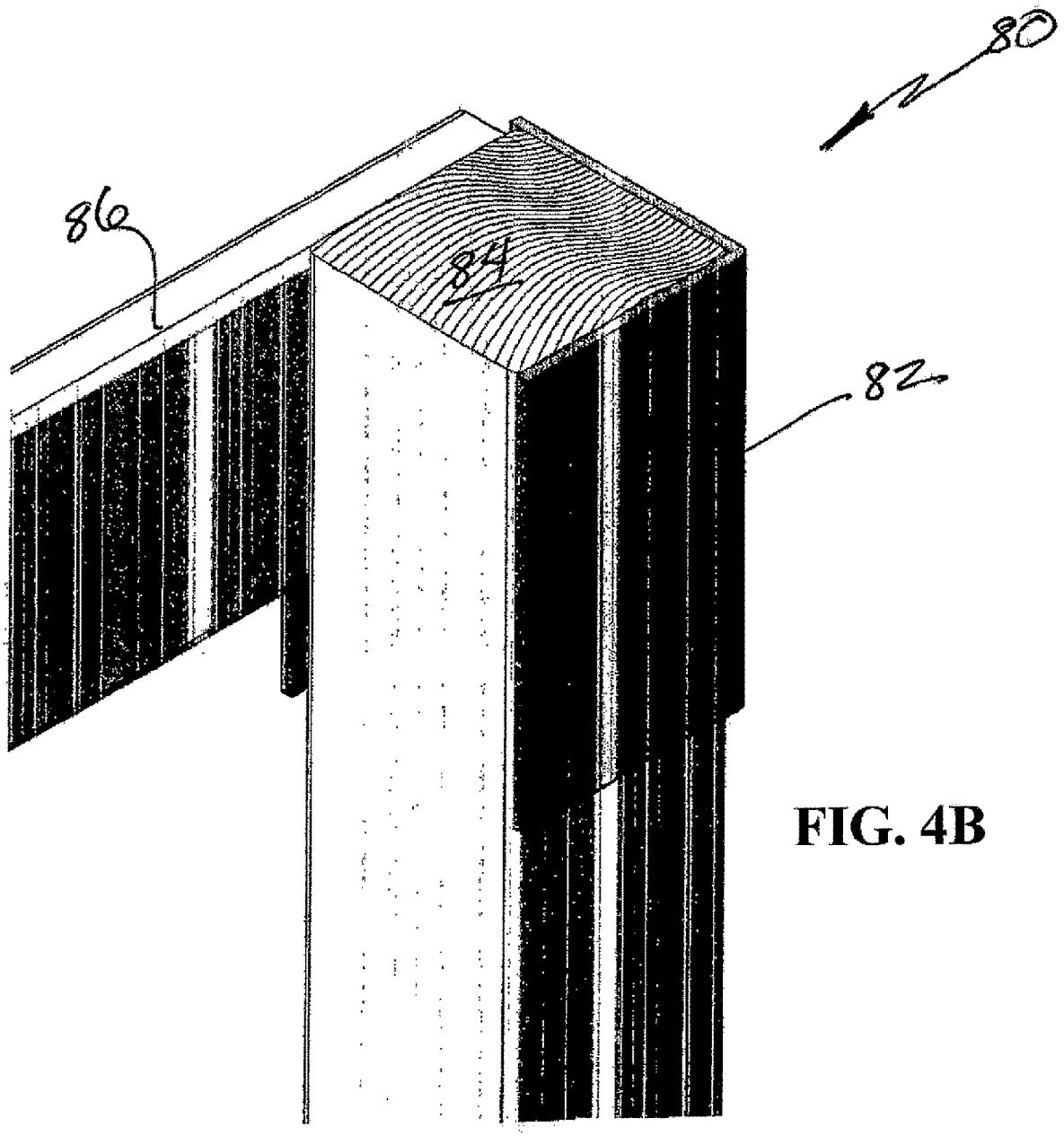
FIG. 4B is a rear perspective view of the invention shown in FIG. 4A.
Figure 4C:
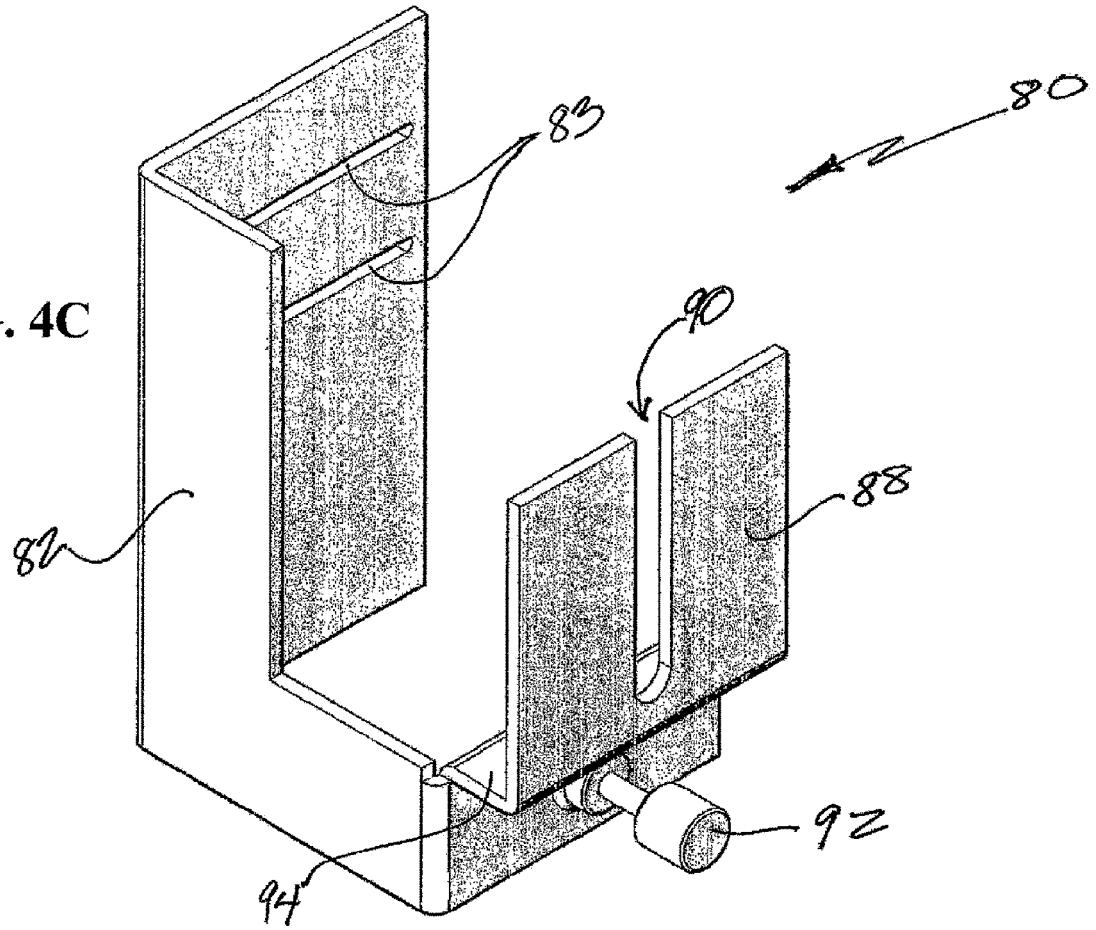
FIG. 4C is a front perspective view of the post-and-beam construction jig without the post being shown therein.

FIGS. 4A-4C illustrate yet another aspect of the present invention, most notably usable for post-and-beam timber frame construction. As one can imagine, post-and-beam timber construction is significantly different from deck construction, as crossbeams must be attached to vertical posts high above the head of a construction worker. Another problem arises because the construction jig of the previous figures could not be lifted up over the top of the post once the crossbeam has been secured, because it would be bumping up against the ceiling of the building. In that regard, this aspect of the present invention is generally denoted by numeral 80, and shows a three sided jig 82 to be pressed up against vertical post 84 from its side. Crossbeam 86 can be secured directly to vertical post 84 by screwing through a slot 90 in the crossbeam support plate 88 after crossbeam 86 has been leveled and set screw 92 secures the jig in its proper position. Crossbeam support shelf 94 helps to secure crossbeam 86 in place.

Looking next to FIGS. 4B and 4C, in FIG. 4B one can see the backside of construction jig 80 showing back rest 82 surrounding vertical post 84 in relative placement with regard to crossbeam 86. The next figure shows construction jig 80 without the vertical post or the crossbeam located therein. One can see the slot 90 in backrest 88 formed in a 90° angle orientation with regard to crossbeam support shelf 94. Construction jig 82 includes pencil slots 83 cut therein to make a level pencil mark on a vertical post which has been received therein so that a cut can be made using that as an indicator for proper placement.

Again, in this aspect of the invention, using the present invention for cutting notches in post and beam construction is facilitated. As one can imagine, in post and beam construction, sliding a jig over a vertical post is not possible because roof components would block such an operation. In that regard, the present invention discloses a novel three-sided jig for indication of the proper location for cutting a notch to receive cross members.

Specifically, disclosed is a construction jig for making notched cuts for post and beam crossmember construction applications, comprising a substantially three-sided jig adapted to be slipped around a vertical post commonly used in post and beam construction. A handle may extend outwardly from a side of the construction jig, wherein the handle is attached to the construction jig, adapted for movable and removable placing of the three-sided jig over the vertical post to indicate level placement for the post and beam crossmember.

An L-shaped crossbeam support portion of the jig extends laterally outward from a side of the construction jig, such that the L-shaped crossbeam support is adapted to receive and hold a crossbeam in place while facilitating its attachment to the vertical post in a level position. Preferably, a level may be attached to the crossmember. By moving the jig up and down with the handle until the level shows that the crossmember is level, the perfect position for the cut to make the notched cut is indicated.

An optional set screw may be integral with the construction jig, so that the jig can be secured into proper position for the cutting operation.

Once the crossmember has been removed, and the jig is set in place, then the worker can cut the necessary notch(s) by traversing saw guides in the jig. Integral saw guides extending horizontally and vertically that correspond to proper level placement for making a level notched cut into the vertical post for receiving the deck crossmember.

This way, the four-sided jig may be slid over and onto the vertical post, while a crossbeam is then placed in the L-shaped crossbeam support and the jig is moved up and down until the crossbeam is level, indicating where the notched cut must be made. By using the jig, this operation of cutting out the necessary notch can be implemented reliably every time with only one worker.

Figure 5A:
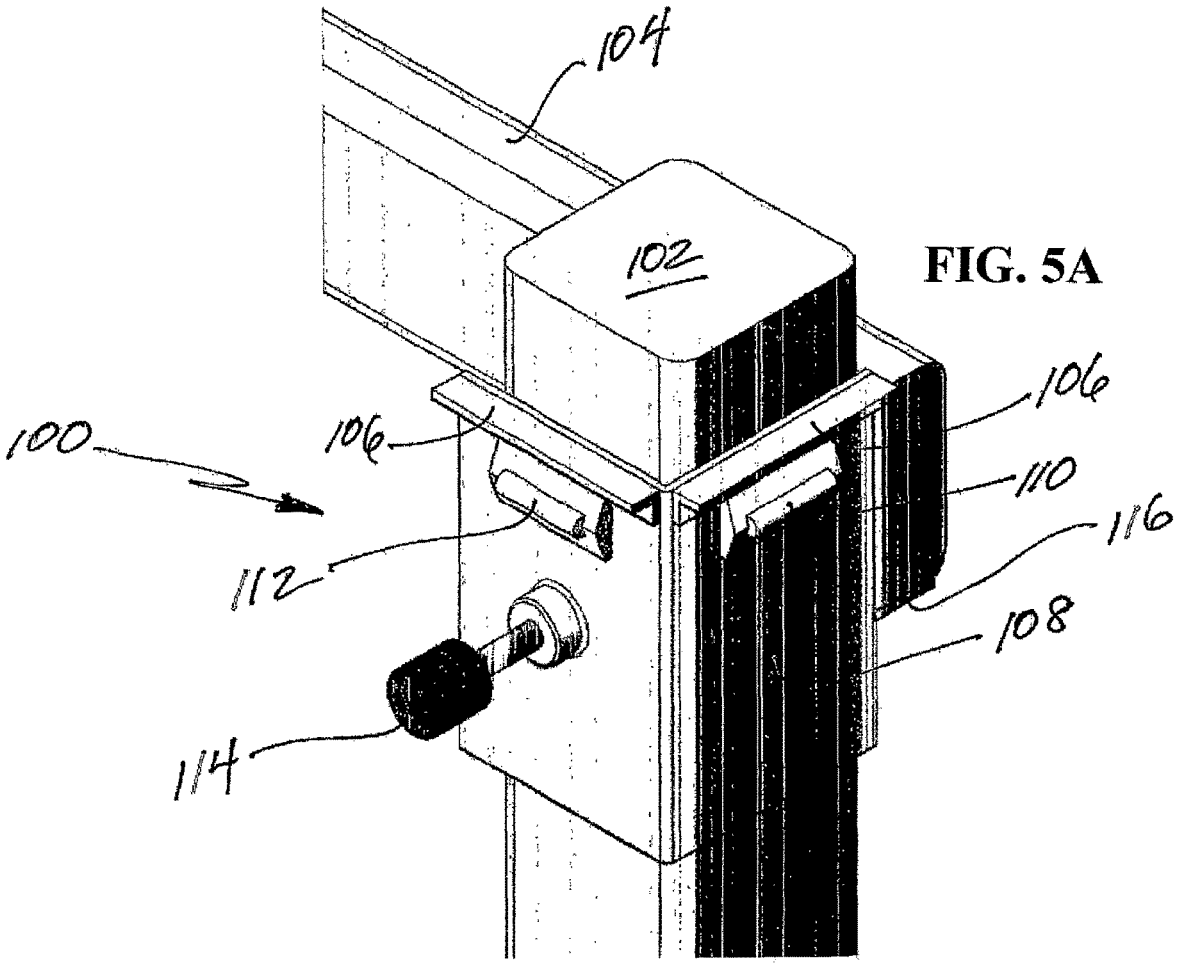
FIG. 5A is a front perspective view of another aspect of the present invention to be used for fence post construction.
Figure 5B:
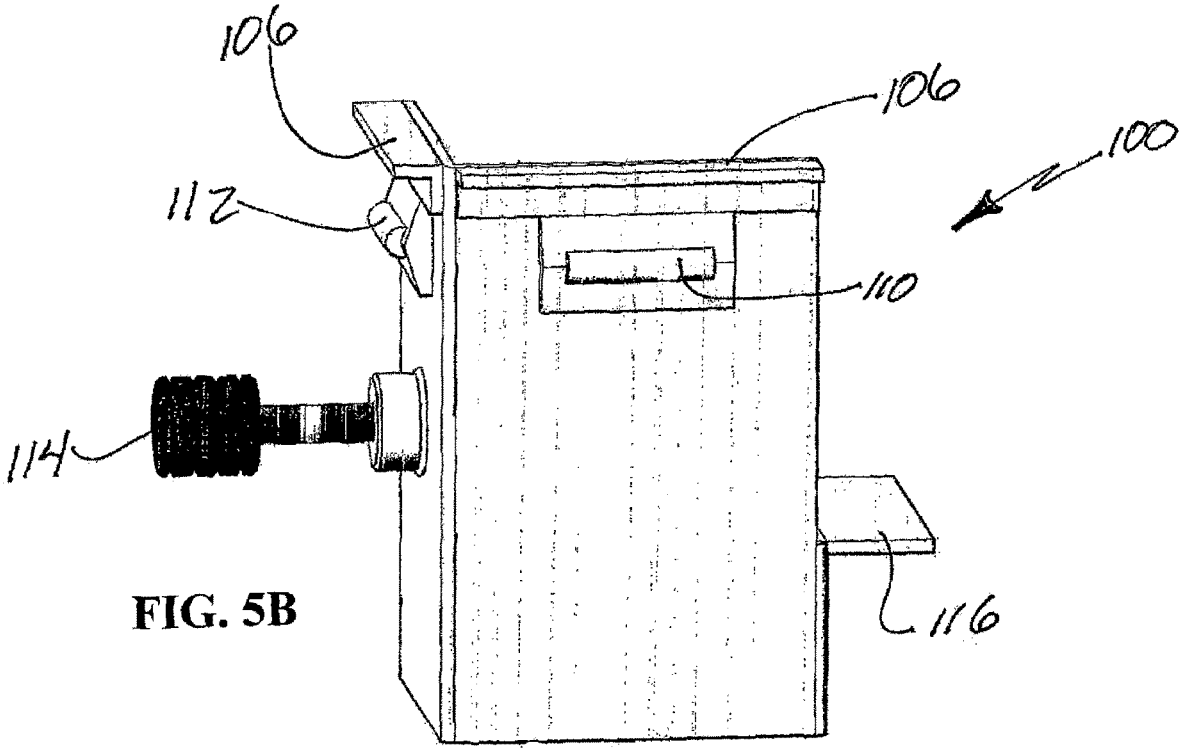
FIG. 5B is a front elevational view of a leveling aspect of the invention.
Figure 5C:
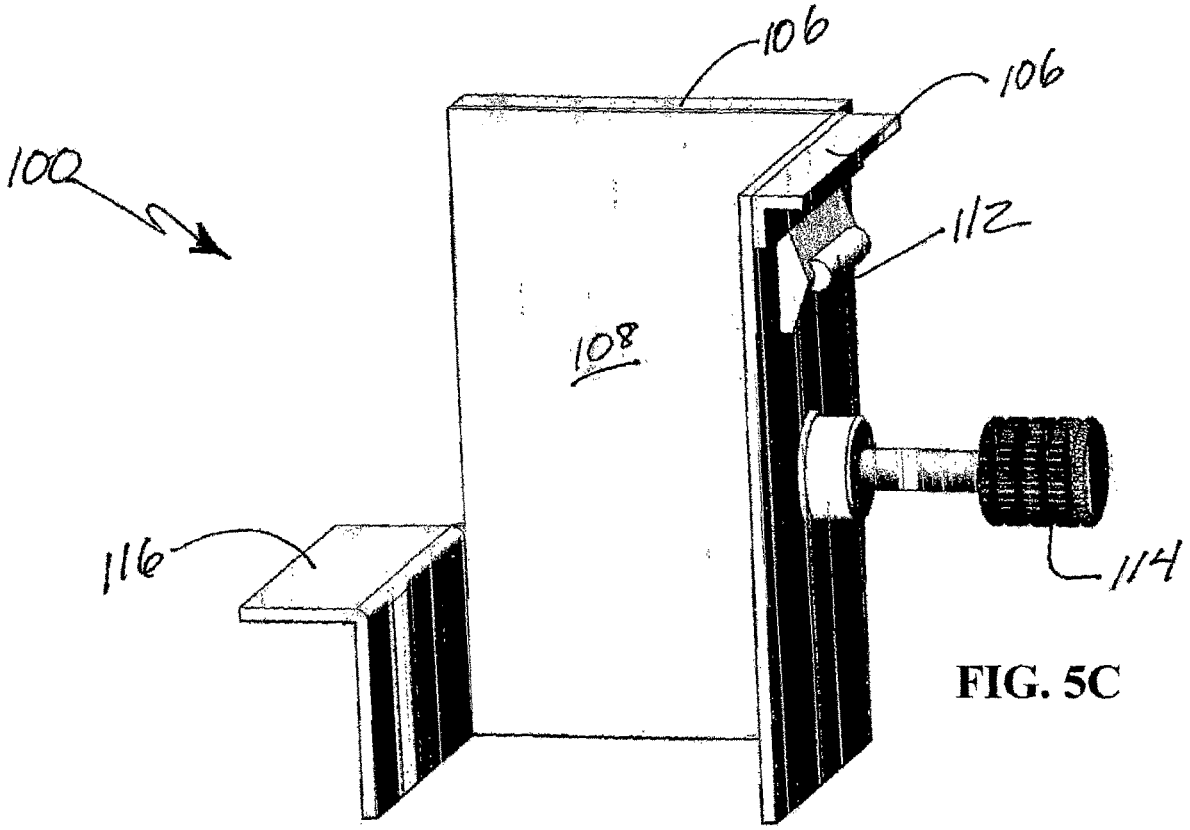
FIG. 5C is a side elevational view of this aspect of the present invention.

Lastly, we look at FIGS. 5A-5C which disclose yet another aspect of the present invention that includes leveling indicators attached to the construction jig generally denoted by numeral 100. Construction jig 100 is shown around vertical post 102 and supporting crossbeam 104 with a plurality of horizontal saw guides 106 atop jig body 108. Side and rear level indicators, 110 and 112, respectively, can be used to place vertical post 102 in an upright position, and leveling crossbeam 104 into proper place. Once the level indicators 110 and 112 show that the crossbeam and vertical post are in proper orientation, the jig can be secured by set screw 114 and pencil marks may be run along the top of the horizontal guides 106. Crossbeam 104 can be supported by crossbeam support shelf 116 after construction jig 100 is slid around vertical post 102.

In summary, numerous benefits have been described which result from employing any or all of the concepts and the features of the various specific aspects of the present invention, or those that are within the scope of the invention. The present construction jig acts as a reliable guide for a single construction worker to be able to cut out a reliably level notch out of a vertical post for many applications, or to provide reliable placement for crossbeams and other construction devices.

The foregoing description of various preferred aspects of the invention have been presented for purposes of illustration and description. It is not intended to be exhaustive or to limit the invention to the precise form disclosed. Obvious modifications or variations are possible in light of the above teachings with regards to the specific aspects. The disclosed aspects were chosen and described in order to best illustrate the principles of the invention and its practical applications to thereby enable one of ordinary skill in the art to best utilize the invention in various aspects and with various modifications as are suited to the particular use contemplated.

What is claimed is:

1. A construction jig for making notched cuts for deck and deck crossmember construction applications, comprising:

a substantially four-sided construction jig adapted to be slipped over a vertical post used in deck construction for locating where to saw to notch out the vertical post to receive the crossmember and aiding in leveling of the crossmember prior to permanent securement;

a handle extending outwardly from a side of the construction jig, said handle being attached to the construction jig and being adapted for movable and removable placing of the four-sided construction jig over the vertical post to indicate level placement for the deck crossmember;

an L-shaped crossbeam support of the construction jig, said L-shaped crossbeam support extending laterally outward from the construction jig, said L-shaped crossbeam support being adapted to receive and hold a crossmember in place while facilitating its attachment to the vertical post in a level position; and integral vertical saw guides defined by parallel notches cut out of sidewalls of the jig, said saw guides extending horizontally and upwardly that correspond to proper level placement for making a notched cut into the vertical post for receiving the deck crossmember.

2. A construction jig for making notched cuts for post and beam construction applications, comprising: a substantially three-sided construction jig adapted to be slipped around a vertical post used in deck construction for locating where to saw to notch out the vertical post to receive crossbeams and aiding in leveling of the crossbeams prior to permanent securement;

a handle extending outwardly from a side of the construction jig, said handle being attached to the construction jig and being adapted for movable and removable placing of the three-sided construction jig over the vertical post to indicate level placement for the crossbeam;

an L-shaped crossbeam support of the jig, said crossbeam support extending laterally outward from the construction jig, said crossbeam support being adapted to receive and hold a crossbeam in place while facilitating its attachment to the vertical post in a level position; and integral vertical saw guides defined by parallel notches cut out of sidewalls of the jig, said saw guides extending horizontally and vertically that correspond to proper level placement for making a notched cut into the vertical post for receiving the crossbeam.

* * * * *